US007437783B2

(12) United States Patent
Navarro et al.

(10) Patent No.: US 7,437,783 B2
(45) Date of Patent: Oct. 21, 2008

(54) EASILY ASSEMBLED BED FRAME

(75) Inventors: Joseph M. Navarro, Winston Salem, NC (US); David W. Stroud, Lexington, NC (US); Robert A. Bartelsmeyer, High Point, NC (US)

(73) Assignee: L&P Property Management Company, South Gate, CA (US)

( * ) Notice: Subject to any disclaimer, the term of this patent is extended or adjusted under 35 U.S.C. 154(b) by 377 days.

(21) Appl. No.: 11/215,702

(22) Filed: Aug. 30, 2005

(65) Prior Publication Data

US 2007/0044235 A1 Mar. 1, 2007

(51) Int. Cl.
*A47C 19/00* (2006.01)
*A47C 23/00* (2006.01)

(52) U.S. Cl. ..... 5/201; 5/286; 5/304

(58) Field of Classification Search ..... 5/200.1, 5/201, 282.1, 286, 304, 310, 203, 285, 207
See application file for complete search history.

(56) References Cited

U.S. PATENT DOCUMENTS 984,823 A 2/1911 Linden
1,463,161 A 7/1923 Gale
1,467,824 A * 9/1923 Ahlers ..... 411/270
1,833,692 A 11/1931 Silvio
2,648,073 A * 8/1953 Nowell ..... 5/285
2,823,392 A * 2/1958 Barry ..... 5/310
2,985,894 A * 5/1961 Goldberg ..... 5/176.1
3,761,970 A 10/1973 Fredman ..... 5/181
3,984,884 A 10/1976 Spitz ..... 5/176 R
4,027,343 A * 6/1977 Hooker ..... 5/200.1
4,196,484 A 4/1980 Harris ..... 5/201
4,694,519 A 9/1987 Benoit ..... 5/200 C
5,996,145 A 12/1999 Taylor ..... 5/200.1
6,216,289 B1 4/2001 Woods ..... 5/200.1
6,463,651 B1 10/2002 Koeneker et al. ..... 29/513
7,089,609 B2 * 8/2006 Jannetides ..... 5/8

* cited by examiner

*Primary Examiner*—Patricia Engle
*Assistant Examiner*—Jonathan J Liu
(74) *Attorney, Agent, or Firm*—Wood, Herron & Evans, LLP

(57) ABSTRACT

A bed frame that can be assembled without the use of additional tools. The bed frame generally comprises a pair of spaced side rails, retainer brackets secured to each side rail, and cross support members extending between the side rails. Each retainer bracket has a base section for supporting one of the cross support members and an aperture extending through the base section. The apertures are aligned with threaded bores in the cross support members so that threaded portions of respective leg assemblies may be inserted through the apertures and used to secure the cross support members to the corresponding retainer brackets.

9 Claims, 4 Drawing Sheets

EASILY ASSEMBLED BED FRAME

FIELD OF THE INVENTION

The present invention relates generally to bed frames, and more specifically, to a bed frame that is capable of being assembled without the use of additional tools.

BACKGROUND

A conventional bed frame has two opposed side rails with a plurality of cross support members, or slats, extending across the side rails for supporting a box spring and mattress. Each side rail is typically formed from an elongated piece of metal having an L-shaped cross-section. Thus, each side rail typically includes a horizontal flange for supporting a portion of the box spring and a vertical flange to help prevent deflection of the side rail under the weight of the box spring, mattress, and any person lying on the mattress. Although such angular arrangement provides structural integrity, each side rail terminates in a sharp lower corner that may be contacted by the ankle or shin of a person making up the bed or the like.

Conventional bed frames may further include several other components. For example, support leg assemblies are usually secured to the side rails or cross members to support the bed frame above a floor surface. Oftentimes the support leg assemblies are positioned slightly inwardly from the side rails to avoid the injurious striking of a person's feet or toes against the leg assemblies. Also, brackets or hooks are typically provided at one or both ends of each side rail for mounting the bed frame to a head board and/or footboard. The brackets are often bolted to the head board or footboard, while the hooks are often designed to engage horizontal pins disposed in a slot on the head board or footboard.

In order to facilitate transportation and storage, the components of a conventional bed frame are typically assembled on site. This assembly process can become quite cumbersome because it usually requires the use of multiple tools. For example, the head board brackets of a conventional bed frame are often secured to the side rails by bolts or other fasteners. Likewise, the support leg assemblies must be screwed or bolted to the cross-support members and/or side rails. The average consumer does not keep the appropriate tools to carry out these fastening operations in his or her bedroom, and must instead search around his or her house for the right equipment before beginning the assembly process. If the consumer does not have the appropriate tools, he or she must make a separate trip to the hardware store to purchase them.

Some manufactures and retailers have attempted to alleviate the frustration associated with such an assembly process by including small tools with the bed frame and fasteners. For example, some manufacturers provide a small alien wrench for securing bolts that have been included with the bed frame. Assembling the bed frame with these small tools is still burdensome, and each time the bed frame is disassembled and stored some or all of the tools and/or fasteners may be misplaced or lost.

Other retailers deliver the bed frames to consumers and provide their deliverymen with the appropriate tools for assembly. However, because the deliverymen travel to many different locations on any given day, the tools may be easily left behind at a particular delivery site. Furthermore, the use of deliverymen does not alleviate any of the frustration associated with disassembling the bed frame for the purposes of storage or the like.

Therefore, there is a need for bed frame that can be easily assembled and disassembled without the use of additional tools.

SUMMARY OF THE INVENTION

The present invention provides a bed frame that is capable of being assembled without the use of additional tools. The bed frame generally comprises a pair of spaced apart side rails, retainer brackets secured to each side rail, and cross support members extending between the side rails. Each retainer bracket has a base section for supporting one of the cross support members and an aperture extending through the base section. The apertures are aligned with threaded bores in the cross support members so that a threaded portion of a leg assembly may be inserted through an aperture in a retainer bracket to engage a corresponding threaded bore in a cross support member.

Thus, the leg assemblies are used to secure the cross support members to the retainer brackets. Such an arrangement allows the bed frame to be easily assembled and disassembled without any tools other than one's hands. Rather than searching for additional tools to complete the assembly process, a person can simply place the bed frame components into their proper positions and turn the leg assemblies by hand to screw the threaded portions of the leg assemblies into the threaded bores of the cross support members to secure all the components together into an assembled bed frame.

In a further aspect of the invention, the side rails are tubular or hollow and have a triangular cross-sectional configuration. Such a design provides a lightweight construction and helps prevent deflection of the side rails under the weight of a box, mattress, and bed occupant. End caps may be slidably received on one end of each side rail to prevent fabrics or the like from "catching" on the bed frame. Alternatively, corner brackets may be secured to the end of each side rail and an end rail may be supported between the corner brackets to round the foot end of the bed frame. Both the corner brackets and end rail may have a triangular cross-sectional configuration designed to match the side rails. At an end opposite the end caps or end rail, a head board support bracket is coupled to each side rail. The head board support brackets include slots for securing the bed frame to a head board with bolts or the like.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
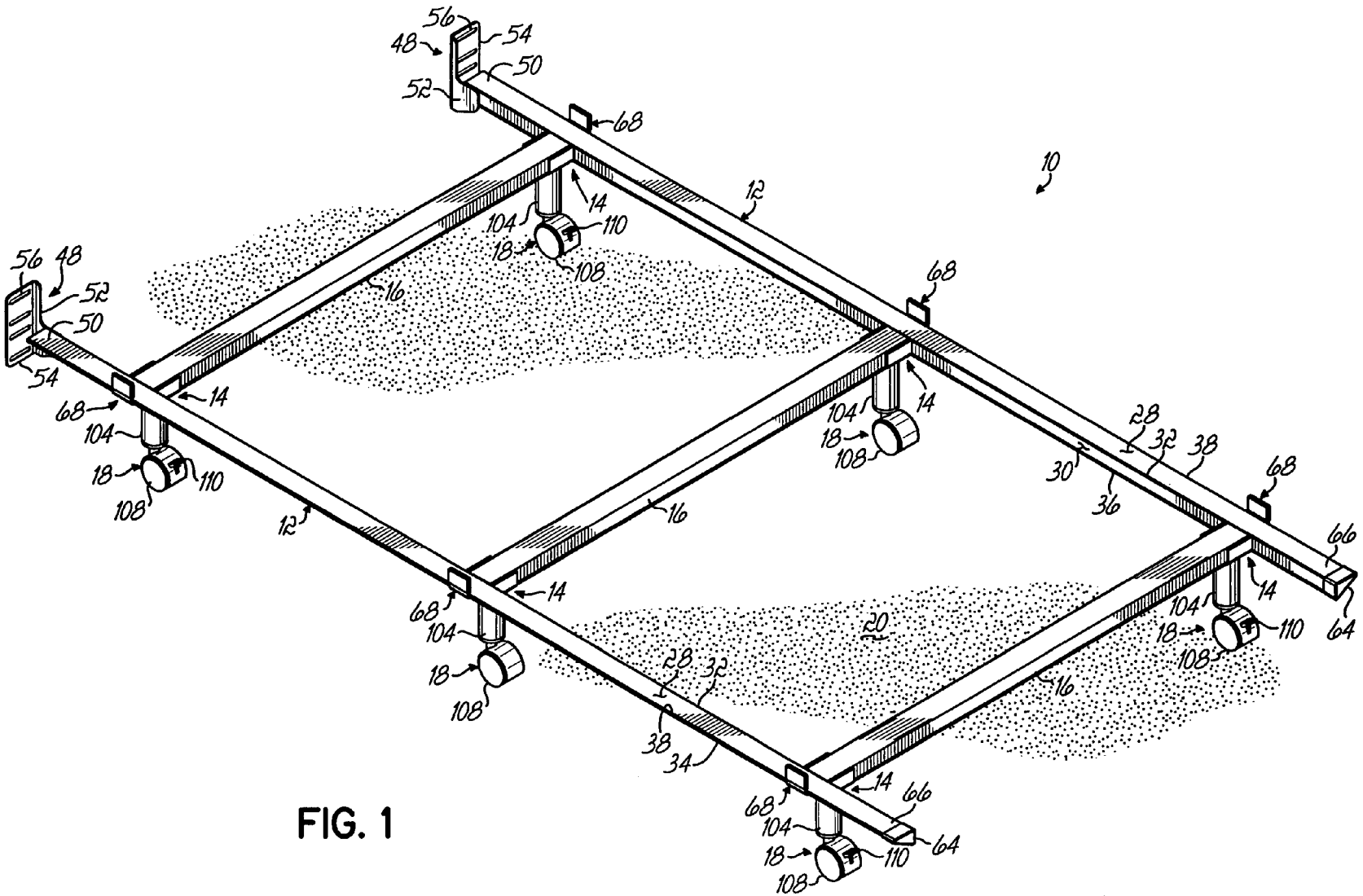
FIG. 1 is a perspective view of a bed frame according to an embodiment of the present invention.

With reference to FIG. 1, a bed frame 10 according to an embodiment of the invention is shown. The bed frame 10 is designed to support a box spring (not shown), and generally comprises a pair of spaced apart side rails 12, retainer brackets 14 secured to each side rail 12, and cross support members 16 extending between the side rails 12. The side rails 12 are preferably aligned parallel to each other and the cross support members 16 preferably extend perpendicularly between the side rails 12. Leg assemblies 18 are used to secure the cross support members 16 to the retainer brackets 12 and support the bed frame 10 above a floor surface 20, as will be described in greater detail below.

In one embodiment, the side rails 12 are formed from a tubular or hollow element having a triangular cross-sectional configuration. As best seen in FIG. 3, each side rail 12 includes a substantially horizontally disposed top wall 28 for supporting the box spring, a substantially vertically disposed inner wall 30 extending downwardly from an inner edge 32 of the top wall 28, and a diagonal outer wall 34 interconnecting a lower edge 36 of the inner wall 30 and an outer edge 38 of the top wall 28. The inner wall 30 extends perpendicularly from the top wall 28 such that the diagonal outer wall 34 forms the hypotenuse of a right triangle. Such a configuration provides the structural advantages associated with an angular design, but eliminates the presence of the sharp lower corner that is often associated with L-shaped side rails. Such a configuration also facilitates access to the space under the bed frame by vacuum cleaner heads or the like. Because a hollow space 40 (FIG. 2) is formed between the top wall 28, inner wall 30, and diagonal outer wall 34 of side rail 12, such a configuration further provides a lightweight construction.

While the description of the remaining figures will be made with reference to the triangular side rails 12, those skilled in the art will appreciate that the side rails 12 may have a number of other cross-sectional configurations. For example, the side rails 12 may be rectangular in nature or even have a conventional L-shaped configuration. Instead of having a tubular design, the side rails 12 may be partially solid or solid throughout so as to eliminate the hollow space 40.

Figure 2:
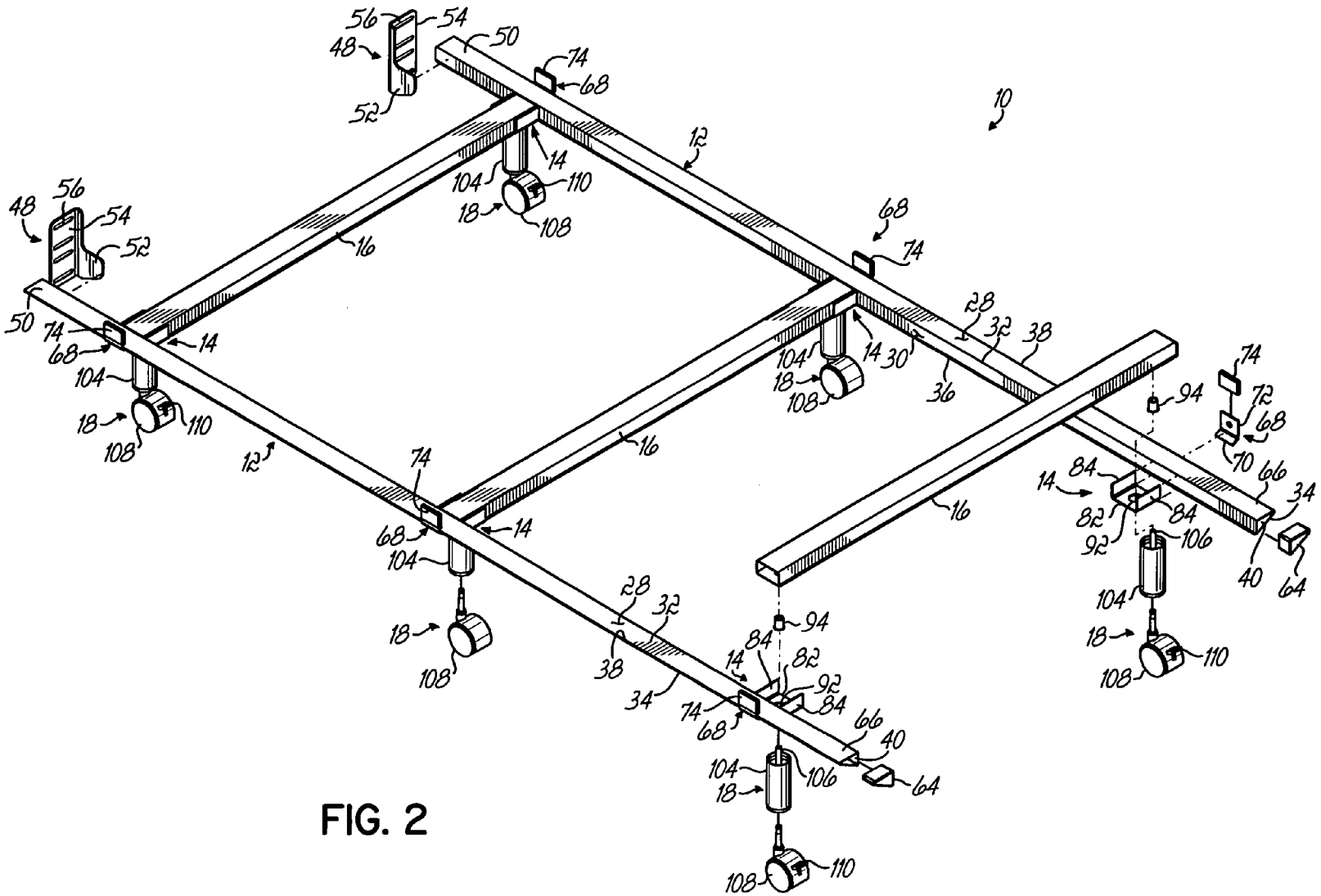
FIG. 2 is a disassembled perspective view of the bed frame shown in FIG. 1.
Figure 3:
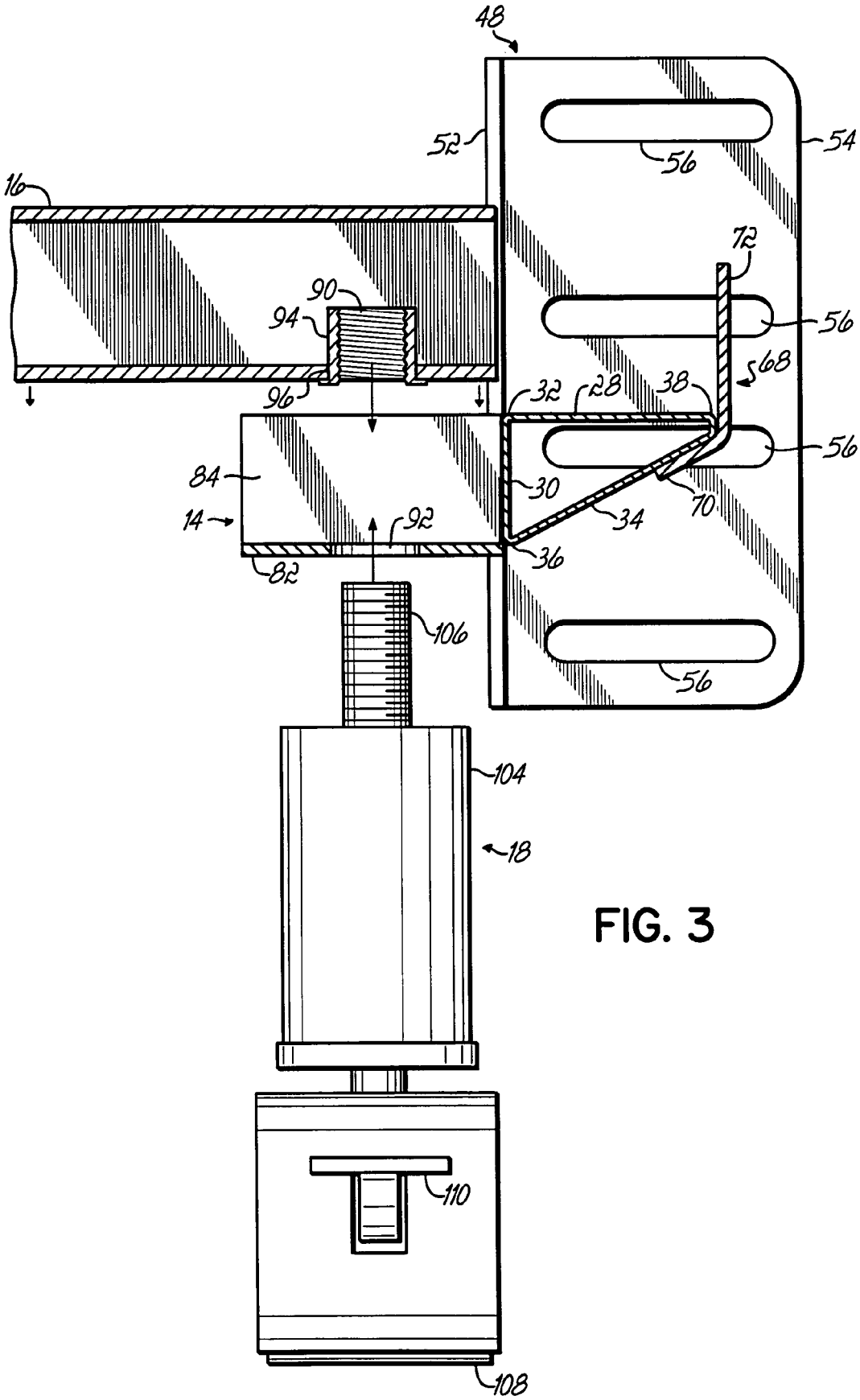
FIG. 3 a front view, partially in cross-section, of a portion of the bed frame shown in FIG. 1.

Now referring to FIG. 2, several components of the bed frame 10 are shown in a disassembled view. As shown in the figure, head board support brackets 48 are coupled to a first end 50 of each side rail 12. The head board support brackets 48 each include an inner flange 52 adapted to cooperate with the vertically disposed inner wall 30 of side rail 12, a substantially vertically disposed end flange 54 extending outwardly from the inner flange 52, and slots 56 disposed in the end flange 54 for receiving bolts (not shown) or other fasteners capable of securing the bed frame 10 to a head board (not shown). In order to provide a rigid construction, the inner flanges 52 of the brackets 48 are preferably welded to the inner walls 30 of the side rails 12.

Opposite the head board support brackets 48, a cap 64 is slidably received over or in a second end 66 of each side rail 12. The caps 64 cover the respective hollow spaces 40 and are designed to prevent the side rails 12 from causing damage to fabrics (not shown) when a box spring is supported thereon.

The bed frame 10 also includes one or more mattress tabs 68 coupled to each side rail 12 between the first and second ends 50, 66. As best illustrated in FIG. 2, each mattress tab 68 generally comprises an attachment portion 70 adapted to cooperate with and be secured to the diagonal wall 34 of the corresponding side rail 12 and a substantially vertically disposed support portion 72. The attachment portion 70 is preferably welded, but may be secured in other ways, to the diagonal wall 34 of the side rail 12 so that the support portion 72 is generally aligned with the outer edge 38 of the top wall 28 of the side rail 12. Thus, the mattress tabs 68 on the spaced apart side rails 12 are adapted to retain a box spring therebetween. A protective cap 74 may be placed over the support portion 72 of each mattress tab 68 to cover any sharp edges and prevent damage to the box spring.

With reference to FIGS. 2 and 3, each retainer bracket 14 extends inwardly from the inner wall 30 of the corresponding side rail 12 and includes a substantially horizontally disposed base section 82 for supporting one of the cross support members 16. Opposed side walls 84 extend upwardly from the base section 82 to form a channel that facilitates receiving and supporting the cross support member 16 on the retainer bracket 14. Although the retainer brackets 14 are shown as separate components in FIG. 2, the brackets are preferably rigidly affixed to the side rails 12 such as by welding or the like.

The cross support members 16 shown in FIGS. 2 and 3 are tubular in nature and have a rectangular cross section. However, like the side rails 12, the cross support members 16 may have a different cross-sectional configuration and may be completely or partially solid. Each side rail 12 is supported by opposed retainer brackets 14 and generally includes a threaded bore 90 aligned with an aperture 92 extending through the base section 82 of a retainer bracket 14. In the embodiment shown in the figures, each threaded bore 90 is formed in a separate insert 94 positioned in an aperture 96 on the corresponding cross support member 16. However, the threaded bores 90 may alternatively be machined into the cross support members 16 or integrally formed therewith.

Still referring to FIGS. 2 and 3, each leg assembly 18 includes a support leg 104 with a threaded portion or threaded projection 106 extending from one end and a caster 108 coupled to the support leg at an end opposite the threaded projection 106. The threaded projections 106 extend through the apertures 92 on the retainer brackets 14 and engage the threaded bores 90 in the cross support members 16. Thus, the threaded projections 106 of the leg assemblies 18 secure the cross support members 16 to the retainer brackets 14. The casters 108 are preferably adapted to swivel relative to the support legs 104 to facilitate moving the bed frame 10 across the floor surface 20. When in the desired location, one or more of the casters 108 may be locked to prevent further movement by actuating a locking member 110 associated with each caster 108.

By providing such an arrangement, the bed frame 10 can be easily assembled and disabled without the use of additional tools. For example, once the components of the bed frame 10 are shipped, delivered, or otherwise transported to the intended location for assembly, the two side rails 12 may be positioned parallel to each other and spaced apart by a distance approximately equal to the length of the cross support members 16. The cross support members 16 may then be placed inside the retainer brackets 14 on each side rail 12 so that the threaded bores 90 are aligned with the apertures 92 on the base sections 82 of the retainer brackets 14. Rather than searching for tools to rivet or screw the components together, a person may simply insert the threaded projection 106 of each leg assembly 18 through a corresponding aperture 92 and into one of the threaded bores 90. The support legs 104 may be conveniently turned or twisted by hand so that the threaded projections 106 engage the threaded bores 90 and secure the cross support members 16 to the retainer brackets 14.

To disassemble the bed frame 10, the steps described above may be performed in reverse order. Thus, the disassembly process also does not require the use of additional tools.

Figure 4:
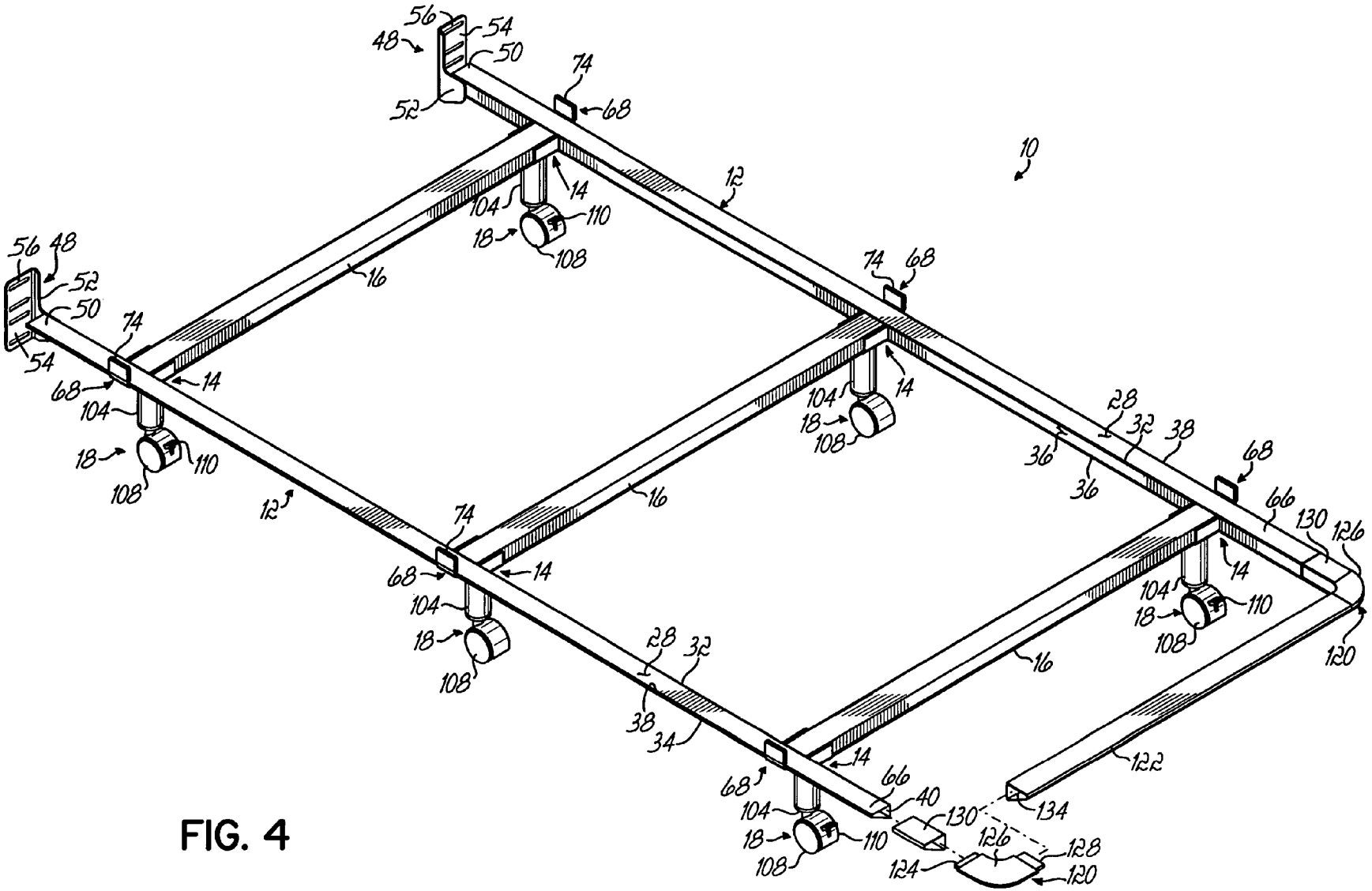
FIG. 4 is a perspective view of a bed frame according to an alternative embodiment of the present invention.

FIG. 4 shows an alternative embodiment of a bed frame 10 according to the invention. Instead of providing an end cap 64 on each side rail 12, the bed frame 10 further includes a corner bracket 120 secured to the second end 66 of each side rail 12 and an end rail 122 extending between the corner brackets 120. The corner brackets 120 have an arcuate configuration with a first attachment portion 124 generally aligned along an axis parallel to the side rails 12, a body portion 126 forming the arcuate contour, and a second attachment portion 128 generally aligned along an axis parallel to the cross support members 16. In order to increase the overall length of the bed frame 10, an extension member 130 may be operatively coupled to each side rail 12 so as to be positioned between the second ends 66 of side rails 12 and corner brackets 120. The cross-sectional configurations of the extension members 130, corner brackets 120, and end rail 122 preferably correspond to the cross-sectional shape of the side rails 12. Thus, the extension members 130, corner brackets 120 and end rail 122 shown in FIG. 4 are preferably tubular or hollow and have a triangular cross-sectional configuration.

The additional components associated with the embodiment shown in FIG. 4 can also be assembled to the bed frame 10 without the use of additional tools. For example, the first attachment portions 124 have reduced cross-sectional areas so that they can be received in the hollow spaces 40 of the respective side rails 12 or in the extension members 130. The second attachment portions 128 have reduced cross-sectional areas so that they can be received in a hollow space 134 of the end rail 122. In this manner, the corner brackets 120 may be secured to the end rail 122 by inserting the second attachment portions 128 into the hollow space 134. The resulting assembly may then be secured to the side rails 12 by inserting the first attachment portions 124 into the hollow spaces 40 or the extension members 130. Those skilled in the art will appreciate that bolts, clips, clamps, and other fasteners may be used to further secure the assembled bed frame 10, even though they are not required.

Therefore, while the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A bed frame assembly, comprising:

a pair of spaced apart, tubular side rails aligned substantially parallel to each other, each side rail having a triangular cross-sectional configuration;

a head board support bracket coupled to an end of each side rail;

at least one substantially vertically disposed mattress tab coupled to each side rail, the mattress tabs being adapted to retain a box spring therebetween;

a U-shaped open top retainer bracket fixedly secured to each side rail, each retainer bracket having a substantially horizontally disposed base section extending inwardly from a corresponding side rail, an aperture extending through the base section, and opposed side walls extending upwardly from the base section of each retainer bracket, said opposed sidewalls extending inwardly from a vertical section of the corresponding side rail along a substantial portion of the base section of the retainer bracket;

a rectangular tubular cross support member perpendicularly extending between the side rails and supported atop the base section of a pair of the retainer brackets and between said opposed side walls so as to position a top surface of said cross support member in substantially the same horizontal plane as a top surface of each side rail, the cross support member having threaded bores aligned with the apertures of the pair of retainer brackets; and leg assemblies securing the cross member to the retainer brackets, each leg assembly comprising:

a support leg having a threaded projection on one end extending through an aperture in the base section of a retainer bracket and engaging the corresponding threaded bore in a cross support member to secure a cross member in an assembled relationship to a retainer bracket and to a cross rail, such assembled relationship being established by hand rotation of the support leg and its threaded projection into a threaded bore in a cross support member; and a caster coupled to the support leg at an end opposite the threaded projection.

2. The bed frame of claim 1, wherein each side rail further includes a cap slidably received on an end thereof.

3. The bed frame of claim 1, further comprising:

a corner bracket secured to an end of each side rail, each corner bracket having a first attachment portion received in the corresponding side rail and a second attachment portion opposite the first attachment portion; and an end rail supported by the second attachment portions such that the end rail extends between the corner brackets.

4. The bed frame of claim 3, wherein each corner bracket has an arcuate configuration.

5. The bed frame of claim 3, wherein the end rail is tubular with a triangular cross-sectional configuration and the second attachment portions of the respective corner brackets are received in opposite ends of the end rail.

6. The bed frame of claim 1, further comprising:

a head board support bracket coupled to an end of each side rail, the head board support brackets being adapted to secure the bed frame to a head board.

7. The bed frame of claim 1, wherein each leg assembly further includes a support leg having a caster coupled support leg opposite the threaded portion of said leg assembly.

8. The bed frame of claim 1, further comprising:

at least one substantially vertically disposed mattress tab fixedly coupled to each side rail, the mattress tabs being adapted to support a box spring therebetween.

9. A bed frame adapted to be assembled without the use of any tools, which bed frame comprises:

pair of spaced apart side rails, each side rail being tubular and having a triangular cross-sectional configuration;

open top U-shaped retainer brackets fixedly secured to and extending inwardly from a vertical section of each side rail, each retainer bracket having a generally horizontal base section and opposed side walls extending upwardly from the base section of said retainer bracket, said base section having an aperture extending therethrough, said opposed sidewalls extending inwardly from a vertical section of a corresponding side rail along a substantial portion of the base section of the retainer bracket;

cross support members extending between the side rails and supported atop the base section of an opposed pair of retainer brackets and between said opposed side walls so as to position a top surface of said cross support members in substantially the same horizontal plane as a top surface of each of side rails, each of the cross support members having a tubular rectangular cross sectional configuration and bores aligned with the apertures of the pair of retainer brackets; a threaded bore insert fixedly secured to the cross support in alignment with the bores of said cross support members and the bores of the retainer brackets; and a plurality of leg assemblies, each leg assembly having a threaded portion extending upwardly through the aperture in one of the retainer brackets and engaging a corresponding threaded bore of an insert in one of the cross support members so as to secure the cross member in an assembled relationship with the retainer brackets and the side rails of the frame, such assembled relationship being established by hand rotation of the leg assemblies relative to the threaded bores of the inserts in the cross support members.

* * * * *

UNITED STATES PATENT AND TRADEMARK OFFICE

CERTIFICATE OF CORRECTION

PATENT NO. : 7,437,783 B2
APPLICATION NO. : 11/215702
DATED : October 21, 2008
INVENTOR(S) : Joseph M. Navarro et al.

It is certified that error appears in the above-identified patent and that said Letters Patent is hereby corrected as shown below:

Column 1

Line 54, “alien wrench” should be --allen wrench--.

Column 2

Line 1, “for bed” should be --for a bed--.

Line 57, “FIG. 3 a” should be --FIG. 3 is a--.

Column 6

Line 49, “pair of spaced” should be --a pair of spaced--.

Line 65, “each of side rails” should be --each of said side rails--.

Signed and Sealed this

Second Day of June, 2009

John Doll

JOHN DOLL
*Acting Director of the United States Patent and Trademark Office*